US006679359B2

(12) United States Patent
Pfeiffer

(10) Patent No.: US 6,679,359 B2
(45) Date of Patent: Jan. 20, 2004

(54) LUGGAGE

(75) Inventor: Michael Pfeiffer, Faistenhaar (DE)

(73) Assignee: MP Michael Pfeiffer Design & Marketing GmbH (DE)

( * ) Notice: Subject to any disclaimer, the term of this patent is extended or adjusted under 35 U.S.C. 154(b) by 0 days.

(21) Appl. No.: 10/157,122

(22) Filed: May 30, 2002

(65) Prior Publication Data

US 2003/0221925 A1 Dec. 4, 2003

(51) Int. Cl.[7] ..... A45G 7/00
(52) U.S. Cl. ..... 190/107; 190/17
(58) Field of Search ..... 190/107, 16, 17, 190/13 H, 103, 117, 900, 901, 124, 24, 18 A; 150/104, 105; 224/609, 610–620

(56) References Cited

U.S. PATENT DOCUMENTS

| | | | | | |
|---|---|---|---|---|---|
| 3,896,909 | A | * | 7/1975 | Kellett | 190/122 |
| 4,270,590 | A | * | 6/1981 | Marshall | 190/100 |
| 4,448,292 | A | * | 5/1984 | Comfort | 190/107 |
| 4,503,955 | A | * | 3/1985 | Fitzsimmons, Jr. | 190/107 |
| 4,540,071 | A | | 9/1985 | Schaub et al. | |
| 5,082,094 | A | | 1/1992 | Nechushtan | |
| 6,050,373 | A | * | 4/2000 | Wonka et al. | 190/103 |

FOREIGN PATENT DOCUMENTS

| | | | | |
|---|---|---|---|---|
| FR | 2052914 | | 4/1971 | |
| FR | 2233010 | | 1/1975 | |
| FR | 2551027 | | 3/1985 | |
| JP | 6-217815 | * | 6/1994 | 190/103 |

* cited by examiner

*Primary Examiner*—Stephen K. Cronin
*Assistant Examiner*—Lien Ngo
(74) *Attorney, Agent, or Firm*—Bacon & Thomas, PLLC

(57) ABSTRACT

Luggage, including a central part formed two mechanically strong, mutually linked half-frames that support two trays defining the central space of the luggage. A connecting frame (40) is mounted between each half-frame and an associated tray and is fitted with a channel (41) within which the tray is affixed by appropriate fasteners. Using the same central parts and connecting frames, a plurality of diverse suitcases or briefcases may be implemented using other trays such as soft trays and.as a result manufacturing costs may be lowered.

7 Claims, 4 Drawing Sheets

LUGGAGE

BACKGROUND AND RELATED ART

The present invention relates to luggage, in particuar lar to a suitcase or briefcase, which is fitted with a central part consisting of two mutually linked, mechanically strong half-frames acting as supports for two shelves or trays spanning the inside space of said luggage.

Such luggage is generally known and widely marketed in the form of carrying cases, briefcases or wheeled suitcases. In general each half-frame of the central part comprises a grip side, a hinging side opposite said grip side, and two mutually opposite lateral parts. The frame and/or the trays may assume arbitrary shapes, for instance rectangular, round or oval.

As regards manufacture, the costliest part of a suitcase case or briefcase is the central part with the two mutually linked half-frames which typically are fitted with, in addition to the hinge, suitcase locks and grips. Presently the frame is generally made of plastic. If use is made of correspondingly high-grade, mechanically strong plastic and of locks of long service lives, then the manufacturing costs of the central part shall be the major portion of the overall suitcase manufacturing costs. As regards plastic-tray suitcases, the trays as a rule are manufactured integrally with the corresponding half-frames, whereas, with cloth or leather suitcases, the corresponding trays are affixed in a very expensive manner onto a metal or plastic frame.

Desirably the manufacturing costs of such suitcases should be reduced by manufacturing in large numbers the other-wise complex and costly frame. However the manufacture of large numbers of components is best attainable if the same component is used in many different models. In the present instance, different suitcases with the same kind of frames should there-fore be manufactured. Moreover the same frame ought to be use-able for suitcases using hard trays and suitcases fitted with soft trays.

As regards conventional suitcases, for instance small or travel suitcases, the volume of the suitcase's inside space most of the time will be constant. As a result different packing volumes will require different suitcases. For a business trip of only a few days, for instance, a smaller suitcase will be needed than on a vacation of several weeks. On the other hand the cost of acquiring several suitcases of different sizes is high, and the suitcases take up much storage space.

In view of this problem, application's U.S. Pat. No. 6,050,373 proposes a suitcases offering variable capacity wherein the suitcases trays are detachably affixed to the half-frames of a central part. Consequently the user may resort to trays of different depths and/or to trays of different shapes while keeping the same central part. In this manner the suitcase capacity can be matched to the particular required packing volume. Applicant's U.S. Pat. No. 6,234,287 describes an especially simple and user-friendly locking system for such exchangeable suitcase trays. This suitcase's central part with the two mutually linked half-frames conventionally consists of a light metal or a rigid plastic, whereas the trays either may be made of a rigid plastic to constitute rigid trays or they may be soft trays made of a soft or resilient material such as leather, fabric, cloth or a light sheetmetal. When using soft trays, that tray zone which shell receive the locking means to affix the tray to the particular half-frame must be reinforced to attain local rigidity. Hence soft trays must be fitted in a complex manner at the tray edge with appropriate rigidifying means. If manufacturing costs are to be reduced, it is desirable to connect soft suitcase trays in an easy and economical manner to the half-frames of a central part.

BRIEF SUMMARY OF THE INVENTION

Therefore, it is an object of the present invention to create luggage, in particular a suitcase or a briefcase of the above-described kind, which, while using a high-grade central part, may be manufactured economically and within a wide range of variations. In particular an objective of the present invention is to provide luggage with exchangeable trays as defined in the patent documents U.S. Pat. Nos. 6,050,373 and 6,34,287 wherein soft trays may be used in simple and problem-free manner while the central part is rigid.

Accordingly an object of the present invention is luggage, in particular a suitcase or a briefcase, comprising a central part comprising two mutually linked dimensionally stable half-frames acting as supports for trays defining the inner space of the luggage, wherein said luggage includes a connecting frame mounted between each half-frame and an associated tray, the connecting frame being fitted with a channel into which the tray is affixed. The connecting frame in accordance with the present invention permits manufacturing a suitcase or a brief-case with very diverse trays. The manufacturing procedure only requires that the particular tray being used be inserted into the connecting frame's channel and then be affixed therein. Accordingly, production may be carried out very economically. The trays may be made of selected materials and may have different shapes and colors. Only the rim of the tray needs to be designed in such a manner as to correspond to said channel's contour and width. Consequently the same frame may be used both for plastic hard trays and, for instance, leather, cloth or aluminum soft trays.

Preferably the connecting channel is peripheral, so that, following insertion of a tray into it, a half-suitcase is subtended which is tightly closed relative to the ambient. Furthermore, appropriate seals such as sealing tape or sealing lips may be mounted inside said channel.

In one variation of the luggage of the invention, the trays are inserted in a frictionally and/or geometrically locking manner into the channel and in general thereafter are longer removable by the user. For instance, the trays may be press-fitted during manufacture into the channel of which the inside width is slightly less than the tray's rim thickness. Moreover detent elements may be fitted into the channel and said channel may be engaged by complementary locking elements at the tray's rim when the tray is inserted into the channel.

To reliably affix the tray into the channel; connecting means other than said frictional and/or geometric connection of tray and connecting frame may be used instead of or besides these latter to affix the tray into the connecting frame's channel. Illustratively the tray may be glued into the channel or be fused with, riveted or sewed into the connecting frame. In a preferred embodiment, the tray is sewn into the connecting frame which in this case preferably is fitted with a channel having a projecting wall that supports the tray when the latter is inserted. Thereupon, using appropriate industrial sewing machines, the seam may be placed in the zone of the projecting wall. Such sewing machines stitching layers of cloth and plastic typically 10 to 20 mm thick are known.

In a first embodiment of the luggage of the present invention, the connecting frame and the associated half-frame are integral. In such case the connecting frame and the half-frame preferably will be an integral, plastic injection-molded component. This particular embodiment of the invention essentially is intended to lower the manufacturing costs of luggage, the same central part being manufacturable jointly with the most diverse trays and therefore the most expensive suitcase component may be produced in large numbers while at the same time, the invention contemplates varying the trays used in the manufacturing procedure, so that a large number of different suitcases can be made.

With respect to a suitcase offering trays exchangeable by the user in the manner of a suitcase disclosed in U.S. Pat. Nos. 6,050,373 and 6,234,287, the connecting frame defined in a second embodiment of the present invention is designed to be connected so as to be detachable from the associated half-frame by the user. In this embodiment the desired trays are inserted and firmly affixed into the channel of the connecting frame during manufacture. If the user wants to use the same central part but with different trays, such user will exchange the subassembly of a particular tray and an attached connecting frame. Considering that locking elements fasten the sub-assembly of a connecting frame and tray to the half frame, which in general shall be rigid, the manufacturing costs for this embodiment also shall be significantly lowered because in this instance as well the detachable connecting frame can be produced in large runs, and still the manufacturer may equip the connecting frame with very different trays, be they hard frames or, preferably, soft trays, of the most diverse shapes, colors and designs. Different trays also may be manufactured very economically because the trays of the luggage of the invention consist merely of the tray proper, that is, they are devoid of any hinge or locking elements.

Preferably the connecting frame shall be an injection-molded component, for instance made of plastic. Illustratively an injection mold may be used to make the connecting frame, said mold being fitted with adjustable slides, whereby the channel width of the connecting frame can be changed by correspondingly adjusting the slides and thus matching such frame to the desired tray thickness.

In case the suitcase comprises a detachable subassembly of tray and connecting-frame, this connecting frame preferably will be dimensioned to terminate flush with the particular half-frame in such manner that only the tray will be visible from the outside.

The luggage of the invention fitted with the connecting frame constituting the transition component between tray and half-frame is especially appropriate for soft-tray suitcases where the tray for instance is made of leather, cloth, soft plastic or aluminum sheetmetal or another light sheet metal.

An illustrative embodiment of the luggage of the invention is elucidated below in relation to the attached drawings.

BRIEF DESCRIPTION OF THE DRAWINGS

FIG. 6 is an enlarged perspective of the connecting frame of FIG. 4.

DETAILED DESCRIPTION OF THE PREFERRED EMBODIMENTS

A preferred embodiment of the luggage of the invention is described below, wherein the trays are detachable and exchangeable by the user. More specifically the connection frame of the invention of the illustrated embodiment is a separate component which is joined to the trays during the manufacturing procedure. However, in an embodiment not shown, said connecting frame also may be integral with the particular half-frame. Such embodiment differs from the illustrated one only in that the connecting frame shown in FIGS. 4 then must be additionally fitted with hinges and optionally with grips and locks and to that extent will correspond to the central part of FIG. 1.

Figure 1:
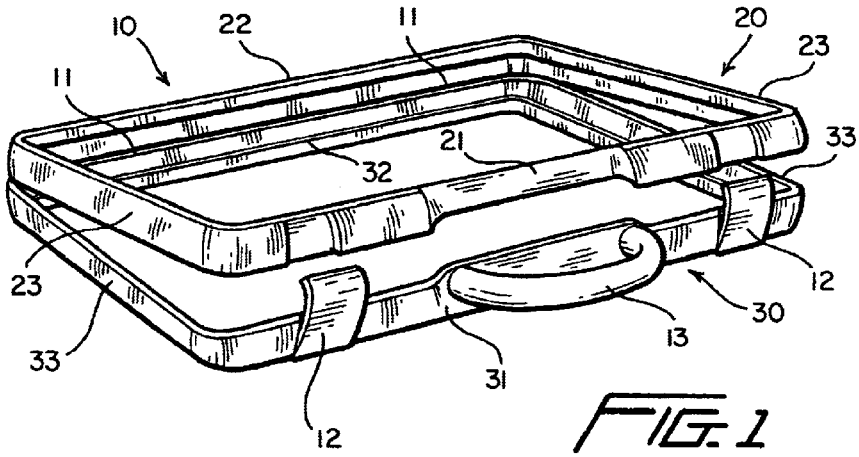
FIG. 1 (PRIOR ART)
FIG. 1 is a perspective of a known central suitcase part fitted with exchangeable trays.

FIG. 1 shows a prior art suitcase central part 10 constituted of two half-frames 20, 30. Each half-frame comprises a grip side 21, 31, a hinge side 22, 32 and two side elements 23, 33. The two half-frames 20, 30 are joined to each other by hinges 11. Locks 12 to lock the suitcase are mounted on the sides of the half-frames 20, 30 that are opposite the hinges 11. A grip 13 is also provided.

Figure 2:
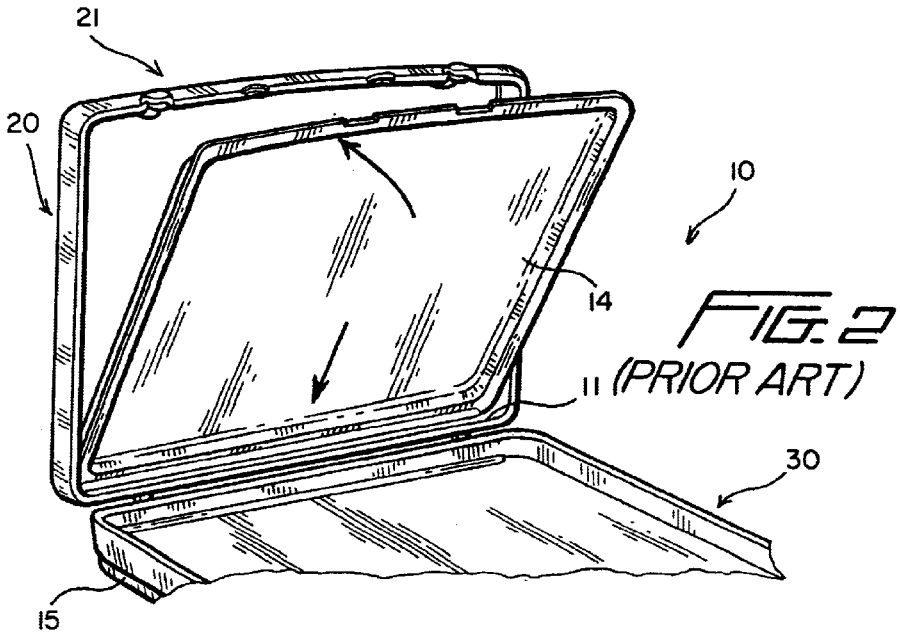
FIG. 2 (PRIOR ART)
FIG. 2 is a partial perspective of the suitcase of FIG. 1, a tray being inserted into the frame of the central part.

FIG. 2 shows how to insert a tray 14 into the half-frame 20. The tray 14 is inserted into a channel formed in the hinge side 22 of the half-frame 20, then it is forced from the inside against a stop on the half-frame's inner side and will be locked when in place. The tray 15 of the half-frame 30 was already inserted in FIG. 1 and locked in the half-frame 30.

Figure 3:
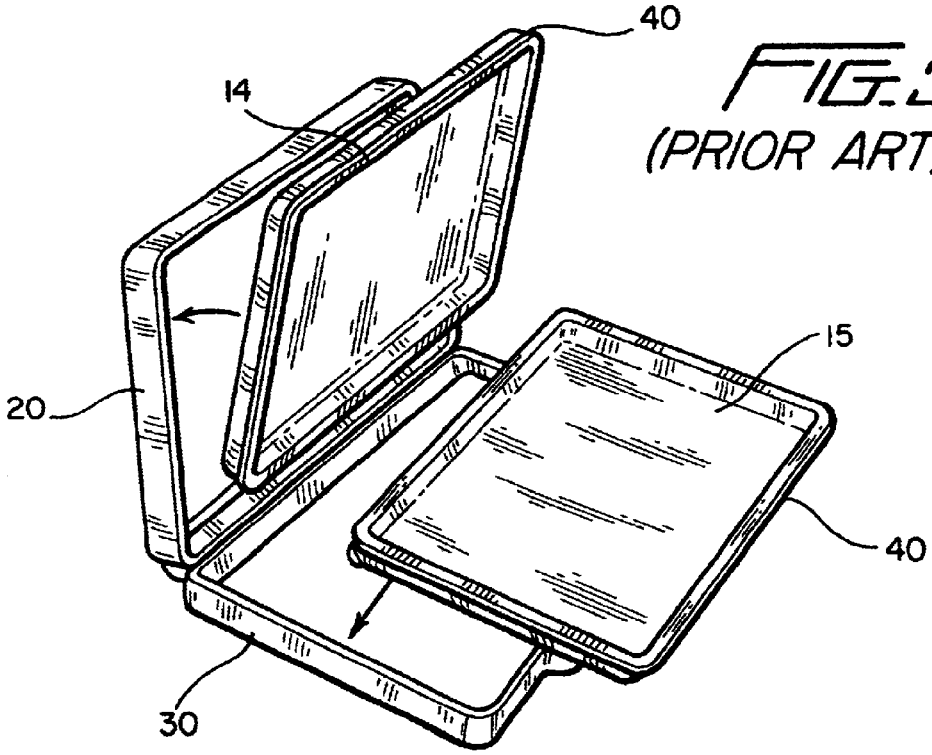
FIG. 3 (PRIOR ART)
FIG. 3 shows a known suitcase assembly including a central part and a total of four exchangeable trays.

FIG. 3 shows a suitcase assembly which, aside from the flat trays 14, 15, also includes two deep trays 16, 17 which the user may arbitrarily exchange and combine.

The exchangeable-tray suitcase shown in FIGS. 1 through 3 is discussed more extensively in applicant's patent document U.S. Pat. No. 6,050,373 and applicant's patent document U.S. Pat. No. 6,234,287, the entirety of these documents incorporated herein by reference, describes in greater detail a preferred locking element and a tray variation wherein, when the suitcase is closed, the mutually opposite trays brace each other.

The trays shown in FIG. 3 each include a connecting frame 40, which is shown only in diagrammatic manner in FIG. 3 but which will be described more fully in relation to FIGS. 4–6.

Figure 4:
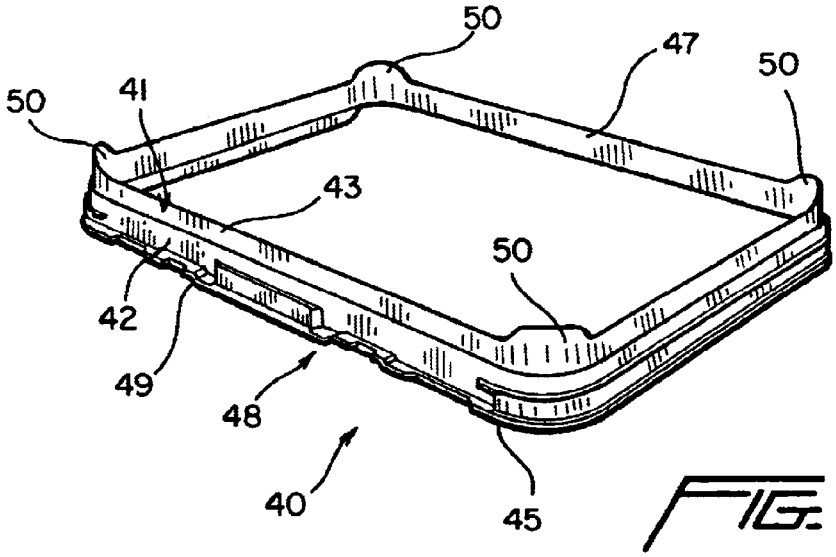
FIG. 4 shows a preferred embodiment of the detachable connecting frame of the luggage of the present invention.
Figure 5:
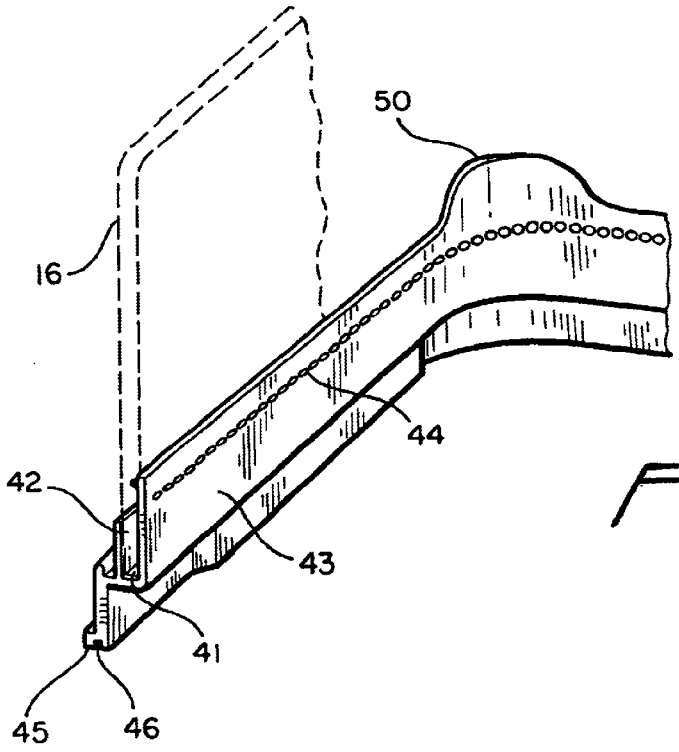
FIG. 5 is a topview of a section through the connecting frame of FIG. 4.
Figure 8:
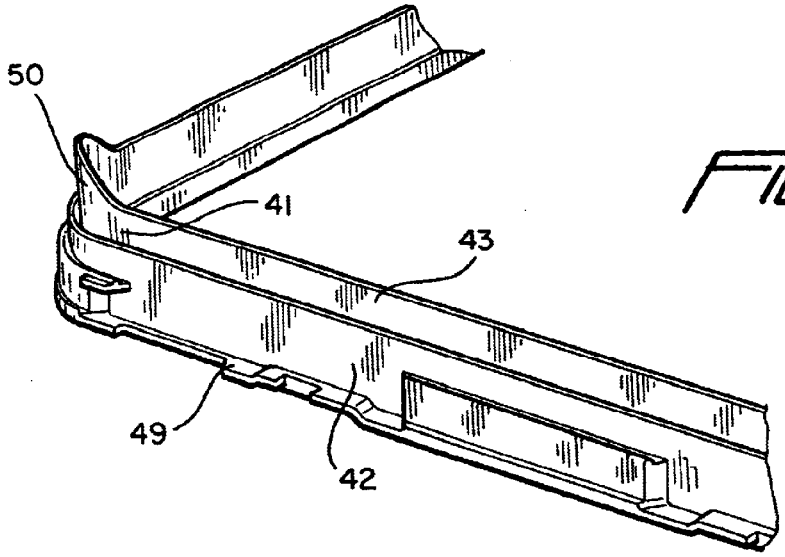

The connecting frame 40 shown in perspective in FIG. 4 has a typical shape which essentially corresponds to the general shape of the half-frames to which they will be fitted. When inserted into the half-frame, the connecting frame 40 has an outwardly extending peripheral channel 41 which during manufacture of the suitcase, i.e. when manufacturing the sub-assembly consisting of the connecting frame and the tray, receives a suitcase tray (not shown FIG. 3). The suitcase tray is shown in dashed lines merely for illustration in FIG. 5 and is denoted by the reference 16. In the embodiment shown, the channel 41 is U-shaped and is bounded by a short sidewall 42 and a long sidewall 43. Once the tray 16 has been inserted into the said channel, it will be affixed therein. Illustratively and as indicated in FIG. 5, this fixation may be by stitching the tray 16 to the longer wall 43 of the channel 41. The corresponding and diagrammatically indicated stitching is denoted in FIG. 5 by the reference 44. Upon insertion of the connection frame into the central part's half-frames, the rim 45 of the connecting frame 40 will extend towards the inside of the suitcase. The connecting frame may be dimensioned in such a manner that the two rims 45 of the mutually opposite half-frames shall abut each other when the suitcase is closed. Therefore, to seal the inside of the suitcase, a clearance 46 may be formed in the rim 45 for receiving an elastic seal, for instance a sealing element. In FIGS. 4 and 6, locking elements 49 are provided on the side 48 of the connecting frame opposite the hinge side 47 such as are disclosed for instance in applicant's patent document U.S. Pat. No. 6,234,287 relating to suitcase trays. In the shown embodiment, the wall 43 is enlarged at the corners and comprises shoulders 50 which provide additional support and protection, in particular in the case of soft trays.

Figure 7:
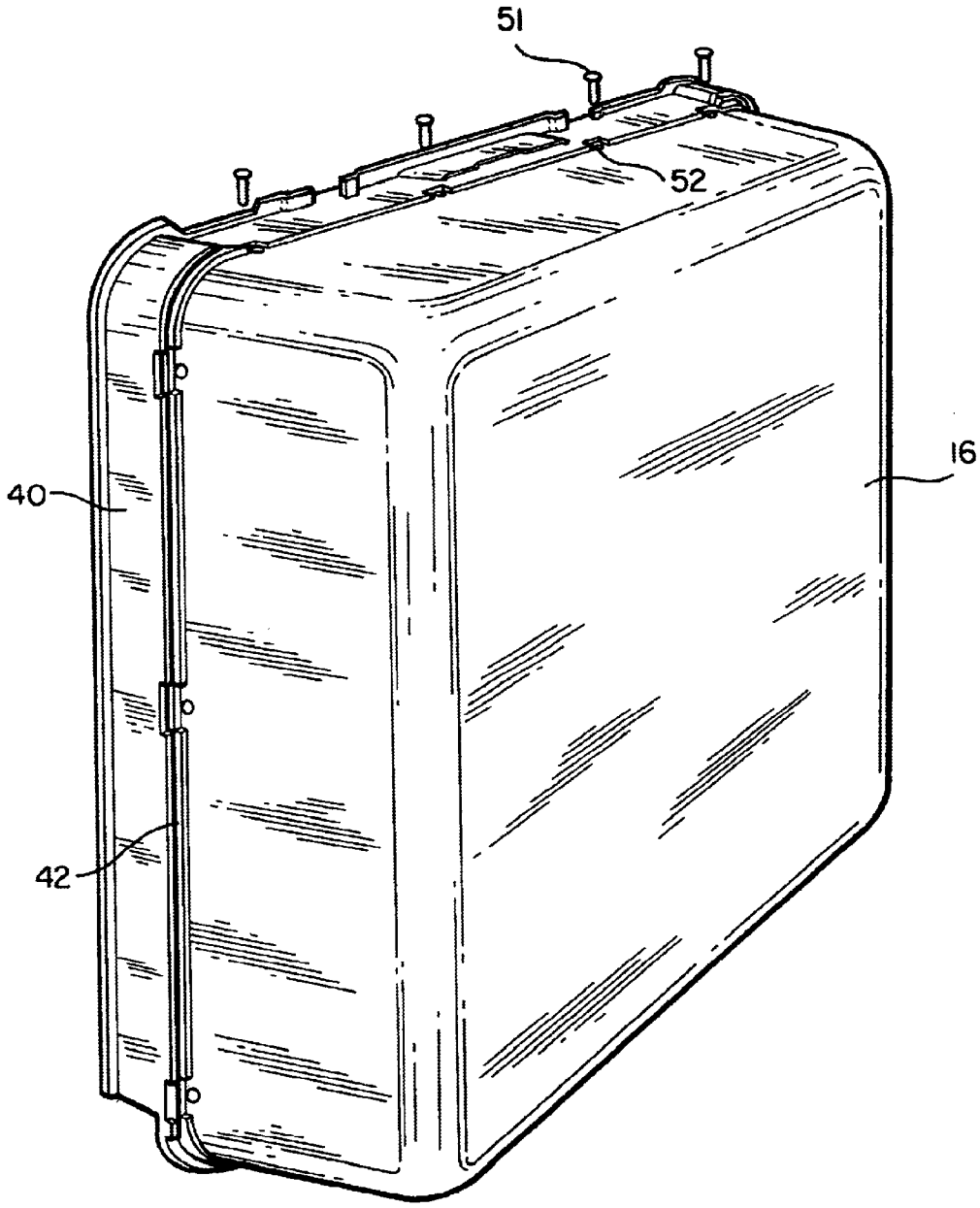
FIG. 7 is an enlarged perspective view showing an embodiment of the invention with a connecting frame secured to a tray.

FIG. 7 shows fasteners 51 received by locating holes 52 of the tray 16 which secure the tray 16 to the connecting frame 40. The tray 16 is received by channel 41 (not shown) bounded by short sidewall 42. as shown in FIG. 5.

It will be understood that only preferred exemplary embodiments of the invention have been described, and that the scope of the invention is to be regarded as presented in the appended claims without limitation by the exemplary embodiments.

I claim:

1. Luggage comprising a central part (10) comprising two mutually linked mechanically strong half-frames (20, 30) that are arranged so as to support two trays (14, 15, 16, 17) defining an inside space of the luggage, and a separate connecting frame (40) detachably mounted to each half-frame (20, 30) and including a channel (41) arranged to receive and connect to one of said two trays (14, 15), said connecting frame (40) connecting one of the half-frames (20, 30) to a corresponding one of said trays (14, 15).

2. Luggage as defined in claim 1, wherein the channel (41) extends peripherally around the connecting frame.

3. Luggage as claimed in claim 1 or 2 wherein the associated tray (14, 15; 16, 17) is retained frictionally or by interference fit in the channel (41).

4. Luggage as claimed in claim 1 or 2 including fasteners (44) affixing the associated tray (14, 15; 16, 17) inside the channel (41) of the connecting frame (40).

5. Luggage as claimed in claim 4, wherein the fasteners (44) affix the tray in a zone of a projecting wall (43) of the channel (41).

6. Luggage as claimed in claim 1, wherein the connecting frame (40) is an injection-molded component.

7. Luggage as claimed in claim 1, wherein the associated tray (14, 15; 16, 17) comprises a soft tray.

* * * * *